United States Patent [19]

Reist

[11] 4,007,824

[45] Feb. 15, 1977

[54] DEVICE FOR EQUALIZING THE SPACING OF SUCCESSIVE STREAM-FED PRINTED PRODUCTS

[75] Inventor: Walter Reist, Hinwil, Switzerland

[73] Assignee: Ferag AG, Hinwil, Switzerland

[22] Filed: May 6, 1975

[21] Appl. No.: 574,941

[30] Foreign Application Priority Data

May 28, 1974 Switzerland ..... 7235/74

[52] U.S. Cl. ..... 198/462; 198/423; 198/472; 198/694; 221/22

[51] Int. Cl.[2] ..... B65G 47/31

[58] Field of Search ..... 198/34, 35, 179, 180, 198/85, 134, 41; 104/167, 252, 253; 271/204, 206; 214/1 BA; 294/99 R, 103 R; 221/22, 23, 47

[56] References Cited

UNITED STATES PATENTS

| | | | |
|---|---|---|---|
| 1,540,687 | 6/1925 | Feistel et al. | 271/204 UX |
| 2,274,075 | 2/1942 | Bombard | 198/35 |
| 2,788,210 | 4/1957 | Sperry | 271/204 X |
| 2,795,861 | 6/1957 | Black | 198/180 X |
| 2,950,914 | 8/1960 | Golding | 271/206 X |
| 3,232,414 | 2/1966 | Brigham | 198/34 |
| 3,236,162 | 2/1966 | Reist | 198/35 |
| 3,446,336 | 5/1969 | Hunziker | 198/34 |
| 3,727,758 | 4/1973 | Cleland | 198/41 X |
| 3,809,214 | 5/1974 | Reist | 198/180 X |
| 3,811,385 | 5/1974 | Johnson et al. | 104/167 |

FOREIGN PATENTS OR APPLICATIONS

| | | | |
|---|---|---|---|
| 1,198,288 | 8/1965 | Germany | 198/35 |

*Primary Examiner*—Evon C. Blunk
*Assistant Examiner*—Richard K. Thomson
*Attorney, Agent, or Firm*—Cushman, Darby & Cushman

[57] ABSTRACT

A device for equalizing the spacing of printed products, such as newspapers, comprises a plurality of spacers movable in a path parallel to the path of the products. Each of the spacers receives the leading edge of a printed product and is driven thereby to a braking device that causes each spacer to abut the preceding spacer. The printed products are carried by a conveyer belt system and a sill raises their leading edges ready for reception by the spacers. After leaving the braking device, the products are deposited from the spacers which are then returned to a magazine to receive further products.

12 Claims, 10 Drawing Figures

DEVICE FOR EQUALIZING THE SPACING OF SUCCESSIVE STREAM-FED PRINTED PRODUCTS

FIELD OF THE INVENTION

The invention relates to the handling of printed products, for example newspapers, which are being fed in a continuous stream. In particular, the invention relates to a device for ensuring that the stream-fed products are regularly spaced.

SUMMARY OF THE INVENTION

It is an object of the present invention to provide a device which equalizes the spacing of printed products that are fed in a continuous stream.

According to the invention such a device is characterized in that a multiplicity of spacers are provided which are guided in a freely movable manner towards and then parallel to the stream-feed transport path and each of which has a driving stop which, in the region of the portion of the spacer guide which is parallel to the stream feed, engages in the path of movement of the leading edges of the printed products so that each of the spacers is driven by a printed product, while at a distance from the beginning of the aforesaid portion of the guide a brake device is provided which acts on the spacers to ensure that the spacers run on to one another.

BRIEF DESCRIPTION OF THE DRAWINGS

Embodiments of the invention are illustrated diagrammatically in the accompanying drawings, in which.

DESCRIPTION OF PREFERRED EMBODIMENTS

Figure 1:
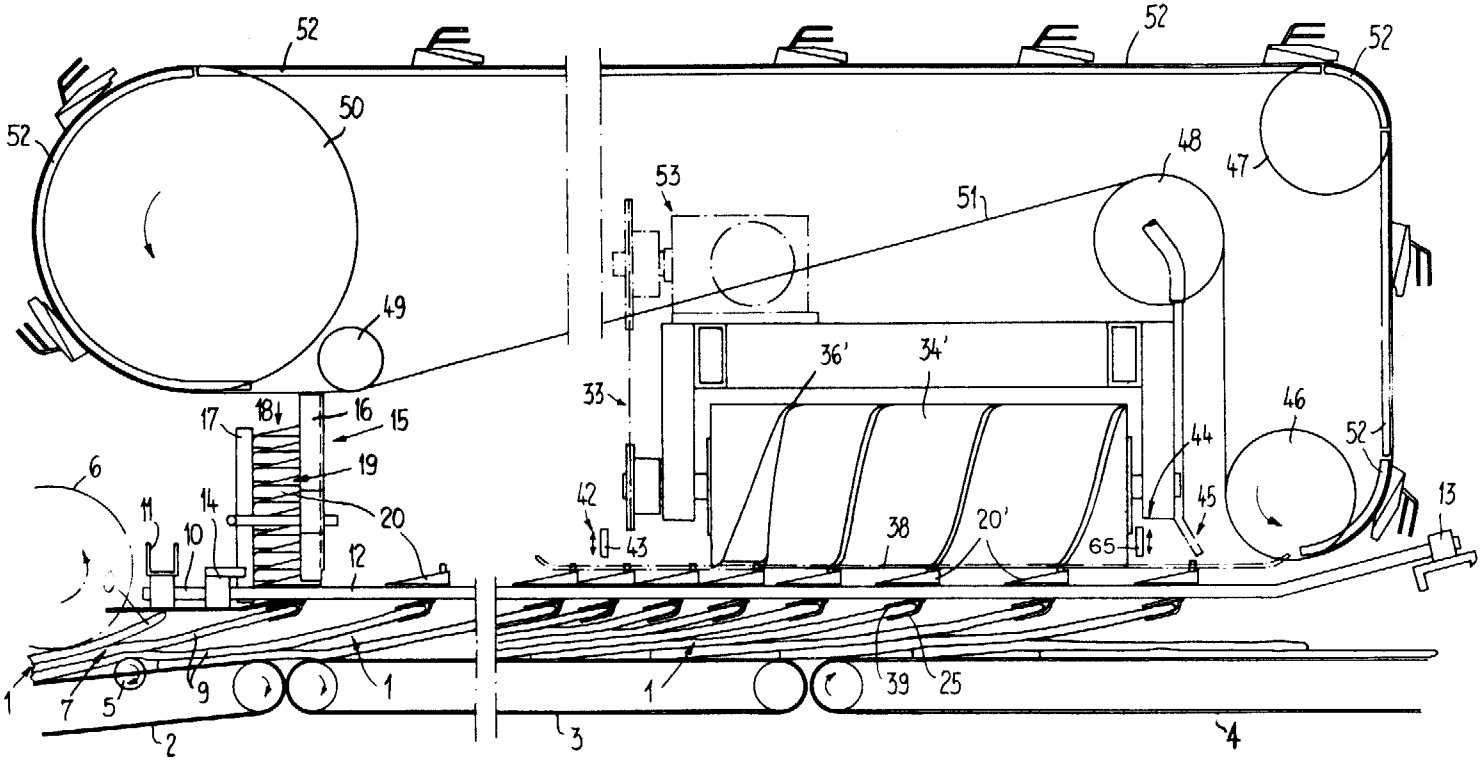
FIG. 1 is a side view of an exemplary device according to the invention.

As shown in FIG. 1, the stream feed formation given the general designation 1 is guided on conveyor belts 2, 3, and 4, which together form the transport path of the stream feed formation 1. It is convenient for the conveyor belt 3 to run at a higher speed than the belts 2 and 4, while however it may have a conveyor surface with lower friction than the other belts. The purpose of these arrangements will be explained in detail later on.

In the region of the conveyor belt 2 are disposed rollers 5 and 6 which are associated with one another and which together form a nip 7 through which the stream 1 passes. Because the roller 5 is disposed at a higher level than the conveyor surface of the belt 2, the leading edge — as indicated at 8 — of the stream-fed printed products, which in the present case are newspapers 9, is lifted until this edge comes to lie on a slide bar 10 and in accordance with the movement of the stream is guided while lying on the said bar. As indicated at 11, the slide bar 10 is mounted on a machine frame (not shown), together with two guide bars 12 which are parallel to one another and which extend side by side and spaced apart parallel to the transport path 2, 3, 4, their other ends likewise being fastened at 13 to the machine frame. According to this arrangement, only one of the guide bars 12, which in the present case have a circular profile, can be seen in FIG. 3.

Figure 4:
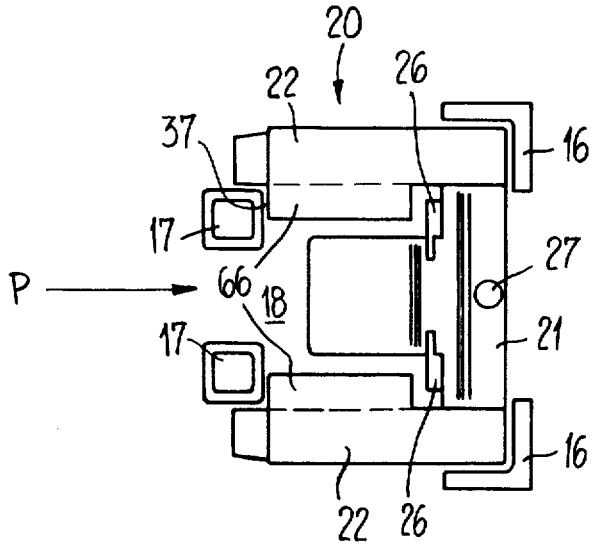
FIG. 4 is a view from above of a spacer in the position of readiness.

A magazine 15 is fastened by means of a mounting 14 on the guide bars and, as can be seen in FIG. 4, has a pair of angle-bars 16 and a pair of hollow bars 17, which together form a vertical guide passage 18. In FIG. 1, only one of the angle bars 16 and one of the hollow bars 17 can be seen, whereas FIG. 4 shows the entire arrangement.

Figure 5:
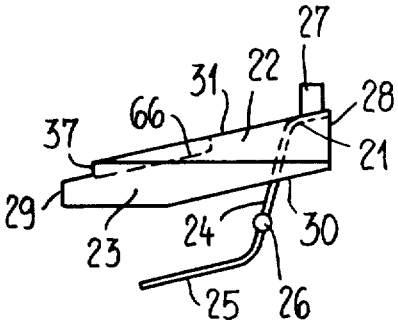
FIG. 5 is a side view of the spacer shown in FIG. 4, FIG. 6 a front view of the spacer shown in FIGS. 4 and 5, viewed from the direction of the arrow P in FIG. 4.
Figure 6:
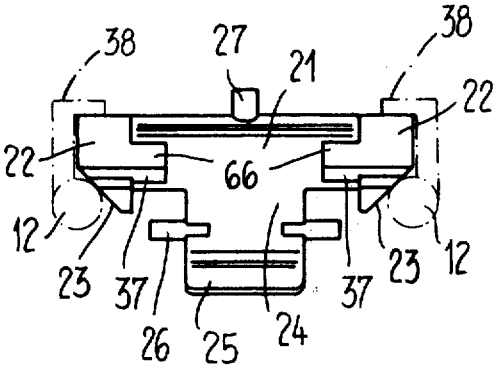
Figure 8:
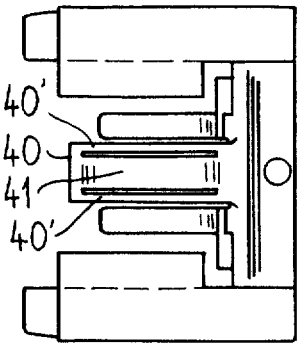
FIG. 8 is a view from above of the spacer shown in FIG. 7, FIG. 9 a side view of the spacer of FIG. 8, and FIG. 10 a front view of the spacer of FIG. 8.
Figure 7:
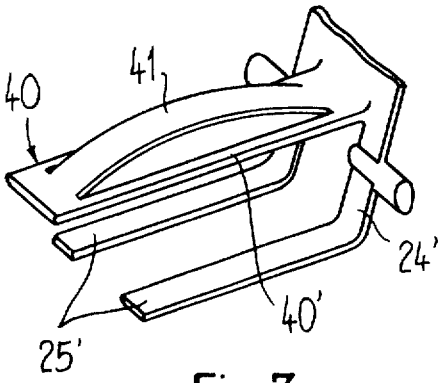
FIG. 7 shows in perspective a modified construction of the spacer.
Figure 9:
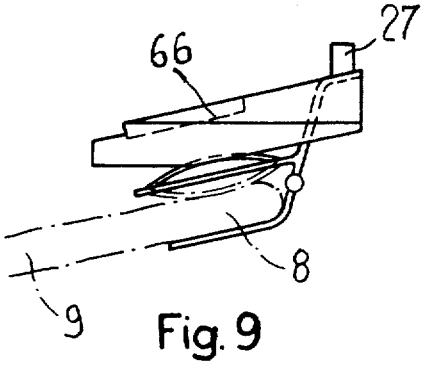
Figure 10:
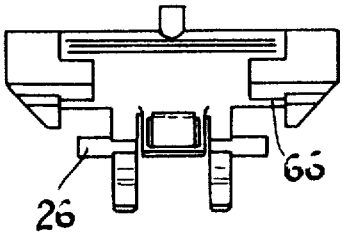

A stack 19 of spacers 20 lying one on the other is disposed in the magazine, the lowermost spacer lying on the guide bars 12. In order to enable this arrangement to be better understood and in particular to explain the construction of the spacers, reference will here first also be made to FIGS. 4, 5, and 6. It can be seen above all from FIG. 4 that the spacers 20 are in the form of a U-shaped bow, consisting of a web 21 and two arms 22 directed at right angles to the web 21. In FIGS. 5 and 6 it can be seen that the arms have slide surfaces 23 which are inclined downwards and inwards, that is to say towards one another, and which rest on the guide bars 12. As can be seen in FIG. 5, these slide surfaces form with the longitudinal axis of the arms 22 an angle such that the web 21 lies substantially above the guide bars 12. FIG. 5 also shows that the web 21 is formed by bent-over sheet material provided with a driving stop 24 which extends downwards (in accordance with FIG. 6 extending between two guide bars 12 to a point below them) and which has a bent-over blade-like extension 25 extending roughly parallel to the arms 22. A feed pin 26 is provided on each side of the driving stop, projecting at right angles therefrom and extending in the direction of the neighboring arm 22. The arms 22 are each provided with a feed lug 66, these lugs extending on the one hand towards one another and on the other hand in the longitudinal direction of the arms and in the direction of the web 21, but only to such an extent (see FIGS. 4 and 5) that they do not overlap the feed pins 26 when the spacer 20 rests on the guide bars 12.

The purpose of these arrangements will be described later on. The same applies to a driving pin 27 which is situated in the middle of the web and extends vertically upwards when the spacer lies on the guide bars 12. In this position the end faces 28 and 29 of the arms (see FIG. 5) are likewise directed vertically. As can be seen from FIG. 4, when the spacers 20 are situated in the guide passage 18 they are also guided by their end faces 28 on the bars 16 and by the ends of the feed lugs 66, remote from the web 21, on the hollow bars 17. The outer and inner sides of the arms 22 naturally likewise participate in the guiding.

Figure 2:
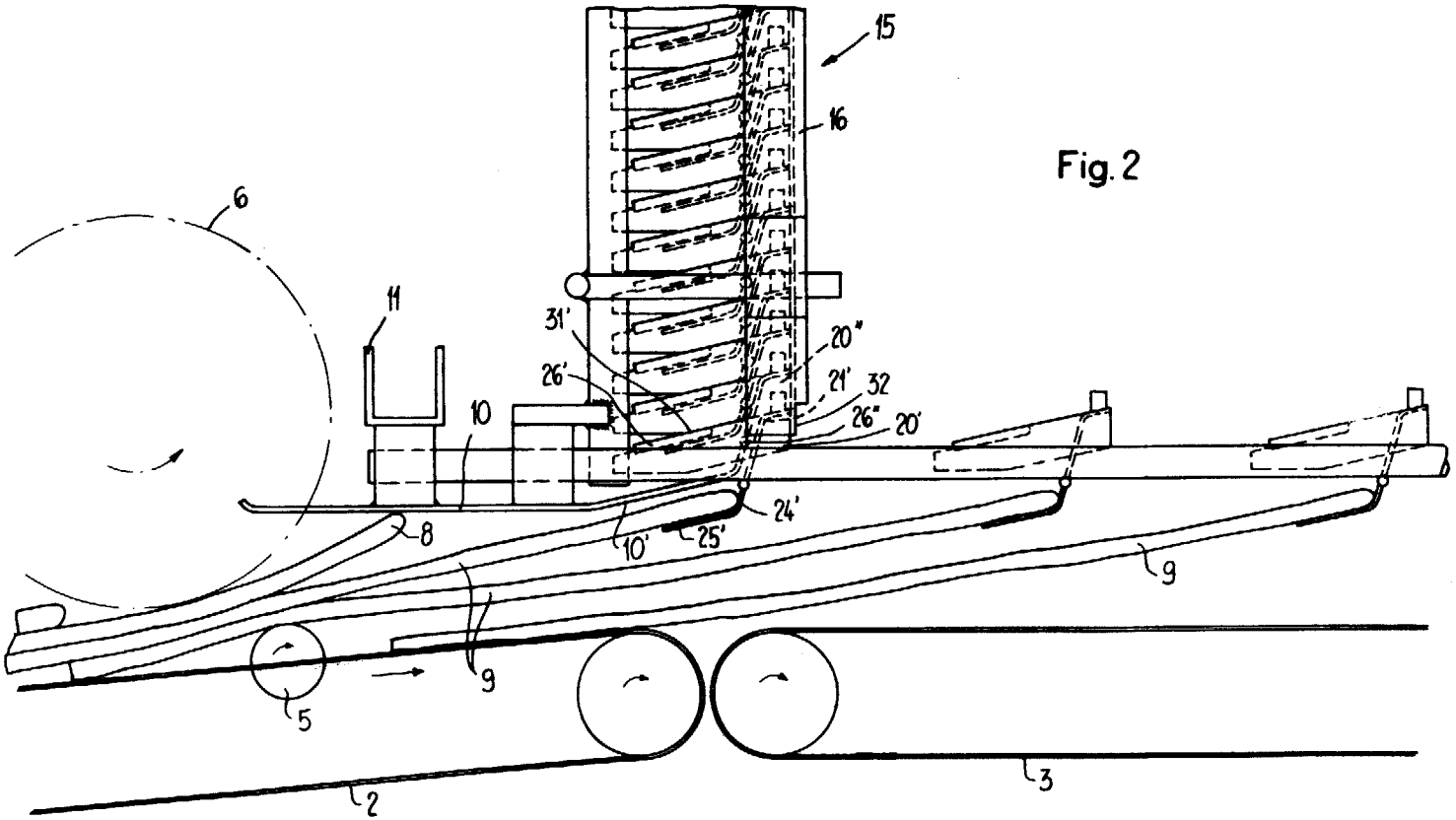
FIG. 2 shows on a larger sacle the part of the device which is on the left in FIG. 1, but with modified stops.

The remarks made can moreover be very easily understood by reference to FIG. 2. In conjunction with FIGS. 4 to 6, FIG. 2 in fact shows that the spacers 20, when they are stacked in the guide passage 18, lie with a lower supporting surface 30 (FIG. 5) of their arms on the upper side 31 of the arms of the next lower spacer, while the lowermost spacer rests on the guide bars 12.

For the sake of better understanding the last-mentioned spacer is designated 20′ in FIG. 2, and the spacer lying above it is designated 20″. The same differentiation is made hereinbelow in respect of the various parts of these two spacers, where these parts are mentioned at all. It can now be seen from FIG. 2 that the feed pins 26″ of the lowest next to the spacer 20″ lie at a slightly lower level than the ends — facing the web 21′ — of the feed lug 66′ of the lowermost spacer 20′, while it should be particularly observed that these feed lugs are inclined so that their other ends extend to a point above the level of the feed pins 26″. From the same Figure it can also be seen that the angle bars 16 are provided above the guide bars 12 with a cutout 32 which enables the lowermost spacer 20′ to be pushed out of the guide passage 18 on the guide bars 12 (to the right in the drawing). During this movement of the lowermost spacer 20′ its feed lugs 66′ run on to the feed pins 26″ of the spacer immediately above it and impart to the latter a downwardly directed advance in accordance with their angle of adjustment. Consequently the next to the lowest spacer 20″, which because it is supported on the inclined upper side 31′ of the arms of the lowermost spacer 20′ will in any case move downwards on the displacement of the latter, is accelerated in the downward direction and placed on the guide bars 12. In this manner one spacer after the other can thus be brought very rapidly out of the magazine 15 along the guide bars 12, since the next spacer is advanced into the position of readiness not only by the weight of the stack of spacers, but also by a positive forward movement.

Refering against to FIG. 2, it can now be seen that the driving stop 24′ of the lowermost spacer 20 in the magazine extends into the path of movement of the leading edge 8 of the newspapers 9 arriving in a fanned-out stream, this path of movement being formed by the slide bar 10 whose end 10′ facing the magazine extends approximately parallel to the extension 25′ of the lowermost spacer 20′. In accordance with this arrangement there is now an operative connection between the leading edge of each newspaper and the driving stop of the spacer which is lowermost at the time in question, with the consequence that, as can be seen particularly clearly in FIG. 2, each of the newspapers takes a spacer 20 out of the magazine and carries it along with it. The constrained advance of the spacer which in each particular case is next to the lowest is of particular importance in this connection, since at the usual stream feed speeds the spacers must be available very rapidly one after the other.

Figure 3:
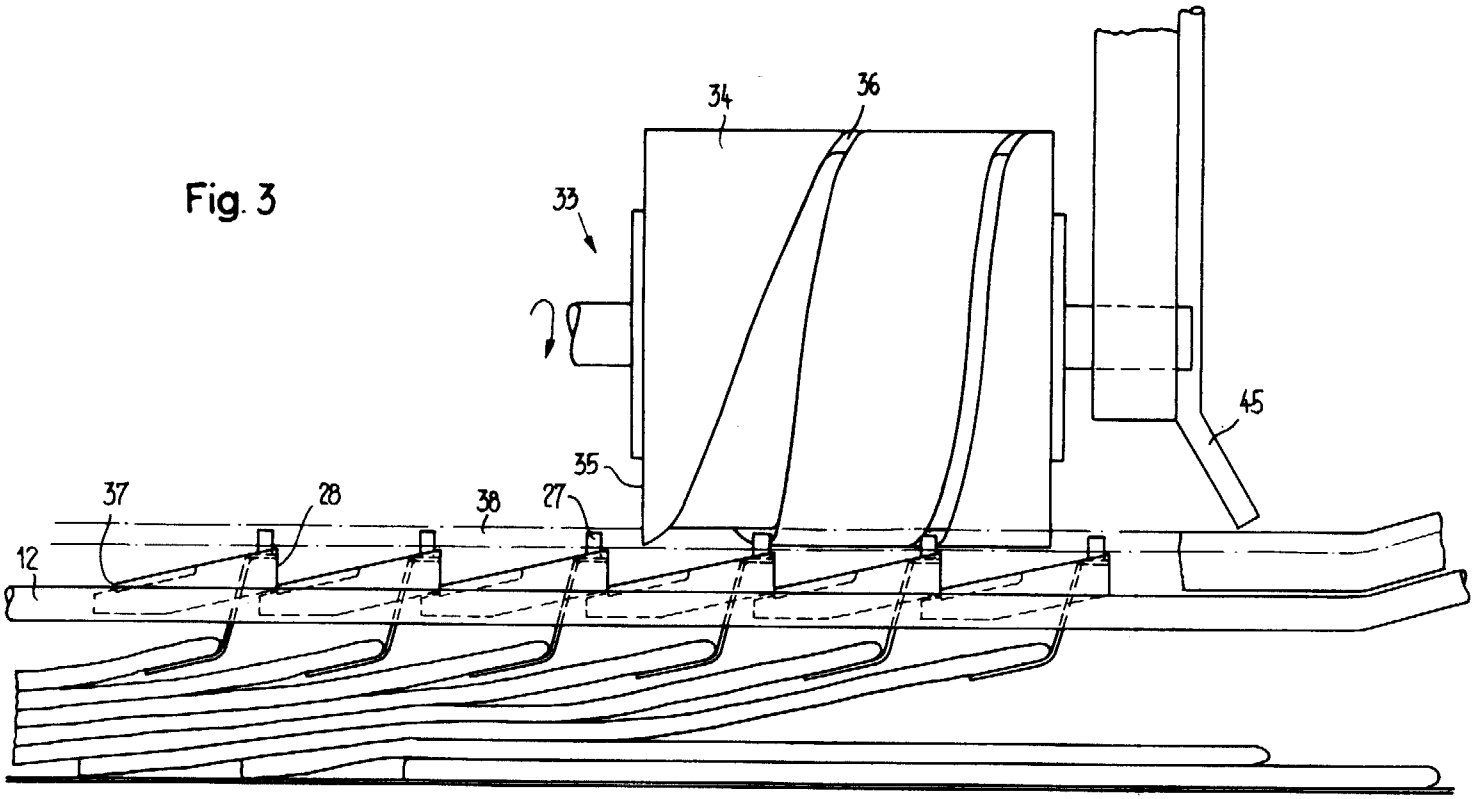
FIG. 3 shows on a larger scale a slightly modified construction of the part of the device which is on the right in FIG. 1.

The spacers carried along by the individual newspapers now slide on the guide bars 12 and, as can be seen firstly from FIG. 2 and then from FIG. 3 in conjunction with FIG. 1, pass into the region of a brake device given the general designation 33. This brake device is here in the form of a rotationally driven grooved roller 34, which is disposed above the guide bars 12 with its axis parallel to them, in such a manner that the spacers travelling with the newspapers come to lie with their driving pins 27 against the end face 35 of the roller 34. The roller 34 has a helical peripheral groove 36 the widened starting portion of which has its mouth on the end face 35. The spacers 20 arriving at the roller 34 are therefore halted in the corresponding rotational positions of the roller 34 because their driving pins 37 lie against the end face 35, until the mouth of the groove reaches the respective driving pin 37. The latter is then received by the groove 36, while the respective spacer — like all the other spacers — can continue to move in accordance with the path of this groove 36. As an immediate consequence of this arrangement the spacers now run on to one another, being supported by the spacer or spacers whose advance has already been effected by the roller 34. For the purpose of supporting the spacers against one another use is made on the one hand of the end face 28 of the arms 22 in conjunction with the free end surface 37 of the feed lugs 26, these end faces 37 merging into a corresponding stepping of the ends of the arms 22 (see FIGS. 3 to 6). In the region of the brake device 33 there are also provided, above the guide bars 12, holding-down bars 38 which, as can be seen in FIG. 1, can extend in both directions considerably beyond the roller 36. These holding-down bars additionally ensure that the following spacers will not jump over the end faces 37 serving as stops for them. Thus, as can be seen in FIG. 3, these spacers accurately determine the mutual spacing of the successive stream-fed newspapers. The pitch of the groove 36 in the roller 34 is selected to coincide with this spacing. In these circumstances, in addition to the braking of the arriving spacers, the purpose of the roller 34 is limited to allowing the newspapers, which are supported on the spacers gripped by the groove 36, to pass through and be carried further in accordance with a determined transport plan (that is to say in a determined phase). The purpose of this arrangement will also be explained later on.

With the aid of the Figures previously mentioned the following intermediate conclusions can be drawn in connection with the mode of operation of the apparatus: the stream is passed through the nip 7 of the rollers 5 and 6, the leading edge 8 of the newspapers being raised and with the aid of the sliding bar being brought against the driving stop 24′ of the spacer lying in the lowest position in the magazine 15 at the time in question. In this way, each newspaper carries with it a spacer, which is first guided on the bars 12 and then is also guided with the aid of the bars 38. The feed stream is carried further by the belts 3 and 4, the belt 3 preferably running more quickly than the other two belts, but having a surface with reduced friction in order not to damage the newspapers. The spacers carried along are braked with the aid of the brake device 33, so that they run on to one another and determine the spacing of the newspapers. In the embodiment shown in FIG. 3 the newspapers are passed on by the roller 34 while this spacing is retained, and — as is immediately clear — the timing is effected by the speed of rotation of the roller 34 in conjunction with the rotational position or positions in which the driving pins 27 of the spacers engage in the groove 36 and pass out of this groove.

The embodiment shown in FIG. 1 coincides basically with that shown in FIGS. 2 and 3, with the exception of the construction of the roller, which in FIG. 1 is designated 34′, while as the result of this difference modified spacers are here also used. The roller 34′ differs from the roller 34 in that it has a groove 36′ whose pitch is progressive, so that the spacing of the spacers still lying on one another upstream of the roller is increased again in the region of the roller 34′. In addition to determining the transport plan, the roller here consequently also serves the purpose of adjusting the final spacing of the newspapers.

In this case of course the spacers accelerated by the roller 34′ must correspondingly pull the newspaper forwards. For this purpose the spacers in the embodiment shown in FIG. 1 (where they are designated 20') is equipped with a pulling gripper whose one arm is formed by the extension 25 already mentioned in connection with FIGS. 4 to 6, this extension cooperating with a second gripper arm shown at 39 in FIG. 1. One possible construction of a spacer equipped with a pulling gripper is shown in FIGS. 7 to 10, where for the sake of clarity the parts which are not changed in relation to the spacer 20 are not given references. Modified references are once again allocated to modified parts.

The main difference consists of a central part 40 of the driving stop 24' or of the extension 25' thereof is punched out and extends in the form of a tongue parallel to the extension 25', which is here composed of two parts. This extension 25' and the tongue-shaped part 40 form gripper jaws into which the leading edge of the newspaper runs. A central longitudinal portion 41 of the tongue-shaped part 40 is once again separated by punching cuts from the edges of this part, as can best be seen in FIG. 7, and is stretched so that this portion 41 has a greater length than the corresponding edges 40'. This has the consequence that the portion 41 must curve and thus has a bi-stable clamp element which in addition to the position shown in solid lines in FIG. 7 and in FIG. 9 can assume a downwardly curved position (shown in a dot-and-dash line in FIG. 9). In this last-mentioned position the leading edge 8 of the newspaper 9 is held by clamping, so that the newspaper in question can be accelerated together with the spacer 20'. When the portion 41 is swung up again, the newspaper is freed and the connection can be released by corresponding acceleration of the spacer. How this is done will be explained further on in detail. First however, fundamental details in connection with the operation of the clamp grippers 25', 39 must be mentioned. In FIG. 1 an actuating device is indicated diagrammatically at 42, which has a member 43 adapted to move vertically after the style of a punch. This member 43 for transmission means coupled to it acts on the clamp portion 41 of the spacer moving past, so as to bring it into the clamping position. It is obvious that the member 43 is driven in unison with the machine. For the purpose of opening the grippers 39, 25 an opening device is disposed at the other end of the roller — as indicated at 44, and is in turn provided with a vertically movable member 65 which is driven in unison with the machine and which brings the clamp portion 41 of the spacers 20' into the open position shown in FIG. 7. This could for example be effected with the aid of a pull magnet. It would also be conceivable for the entire part 40 to be subjected to a bending moment in order to open (or to close) the gripper. In this connection it must be vigorously emphasised that although the spacers illustrated in FIGS. 7 to 10 and provided with clamp means and their operation are entirely feasible in practice, nevertheless the description given above is mainly of a symbolic character and serves the purpose of illustrating to the specialist the basic principles of an arrangement of this kind. With this starting point, the specialist's skill and knowledge will then be sufficient to put these principles into practice.

Now that it has been explained how with the aid of the spacers, and optionally with the assistance of the roller 34 or 34', the feed stream is brought "into unison and phase," it must still be explained how the spacers are detached from the stream formation and made available for re-use after serving their purpose. In this connection reference will be made to both FIG. 1 and FIG. 3. In these Figures can be seen a blast pipe 45 downstream of the brake device 33 in the direction of flow and which has a mouth pointing substantially in the direction of flow. Compressed air is passed through this blast pipe. The air jet passing out of the mouth of the past pipe is directed on to the web of the spacers, so that when subjected to the action of this air jet they are driven by impact. Through the action of the air impact the spacers free the leading edge of the newspapers and, while the adjusted spacing is retained, this edge is laid down on the newspaper preceding it, while the spacers move to the end of the guide rods 12. In the end region of these rods is now provided a return roller 46 of an endless belt running around other guide rollers 47, 48, and 49, and on a drum 50. Commencing with the return roller 46 there are disposed along the belt 51 curved or rectilinear segments (all designated 52) of permanent-magnet material, which segments extend approximately to the passage 18 of the magazine 15. With the aid of these magnet segments the space is, whose webs are made of a magnetisable material, are now attached to the belt 51 at the end of the guide bars 12 and are carried along by the belt 51, as indicated in FIG. 1, until they each the portion of the belt extending between the drum 50 and roller 49 above the passage 18. Here the spacers are released or stripped off by a suitable construction of the guide bars 16, so that they continuously replenish the stack 19 contained in the passage. The arrangement is naturally such that this stack has a sufficient buffer stock to comply with any changes of speed of the stream feed. Similarly, the belt drive is adjusted to the delivery path of the feed stream.

The same naturally also applies to the drive, indicated at 53 in FIG. 1, for the roller 34', a buffer zone for the spacers being here again formed upstream of the roller. On the other hand, the operation of the arrangement described is usually syncronized with a following processing station or machine, which in turn requires a feed stream "in time and in phase." As an example of this, the newspapers are subjected to an individual processing operation, for example the known operation of inserting insets. For this purpose each copy of the so-called main product must be brought together with one or more copies of the previous product and/or with a supplement. An insertion machine (whatever its type) can then obviously work under far more favourable conditions if the newspapers are fed to it at regular intervals of time, and at the correct moment of time in each case. This can be achieved with the device described. At the same time it is entirely possible to provide between the insertion machine (or any other processing station, even one of completely different kind) and the device described a conveyor which individually grips the newspapers from a feed stream by means of grippers which in turn are guided at determined intervals, for example with the aid of a chain (on a circulating path). Obviously, it is immediately conceivable for the sole purpose or the main purpose of the device described to consist in bringing the stream feed formation into unison and phase in relation to a conveyor of this kind. In addition, the drive provided by the belt 3 can obviously be so adjusted that the newspapers can follow the acceleration of the spacers (in this case as at 20) through the roller 34' without being clamped.

We claim:

1. A device for equalizing the distance between the leading edges of successive printed products in an imbricated stream of such products, said device comprising transport means defining a transport path for the products; a plurality of spacers, each comprising driving stop means, leading abutment means and trailing abutment means; guide means for guiding said spacers in a freely movable manner in a path parallel to said transport path; storage means for storing said spacers in overlying relation and for directly delivering the lowermost of said spacers to said guide means when the driving stop means of said lowermost spacer is engaged by the leading edge of a printed product, whereby each delivered spacer is pushed by the printed product along said guide means; and brake means disposed at a distance downstream of said storage means for ensuring that each spacer abuts with its leading abutment means against the trailing abutment means of the preceding spacer.

2. A device according to claim 1, in which the transport means comprises means for raising the leading edges of the printed products.

3. A device according to claim 2, in which a slide bar for the leading edges of the printed products commences above the raising means, the slide bar directing said leading edges to the storage means for engagement with the said driving stop of the lowermost spacer in said storage means.

4. A device according to claim 1, in which the guide means comprises guide bars parallel to the said transport path, and the storage means comprises a magazine having guides directed towards the said transport path, the lowermost spacer in the magazine lying on the guide bars and having its driving stop means projecting downwards into the transport path of the said leading edges of the printed products.

5. A device according to claim 4, in which the driving stop means has an extension which is bent over oppositely to the transport path direction and which is adapted to engage under the leading edge of a printed product.

6. A device according to claim 5, in which the driving stop means is provided with a controllable clamp means for the leading edge of the printed products.

7. A device according to claim 1, in which the brake means comprises a roller having end faces, the roller axis being directed parallel to the transport path, said roller having a helical peripheral groove leading into the end faces and provided with a mouth facing the oncoming spacers, the spacers having drivers which, as the result of the movement of the printed product and when the roller is in a corresponding rotational position, engage in said groove through the mouth of the latter and pass out of the groove at its other end.

8. A device according to claim 7, in which the pitch of the groove is constant and corresponds to the spacing between the drivers of spacers which have run one against another.

9. A device according to claim 7, in which the pitch of the groove is progressive, starting from a pitch that corresponds to the spacing between the drivers of spacers that have run one against another.

10. A device according to claim 1 in which following the brake means a return conveyor means is provided for returning the spacers to the storage means.

11. A device according to claim 10, in which the return conveyor means comprises a rotating conveyor belt, the run of the conveyor belt leading to the storage means passing over permanent-magnet segments, the spacers comprising parts of magnetisable material.

12. A device for equalizing the distance between the leading edges of successive printed products in an imbricated stream of such products, said device comprising transport means defining a transport path for the products; a plurality of spacers, each comprising driving stop means, leading abutment means and trailing abutment means; guide means comprising guide bars parallel to said transport means for guiding said spacers in a freely movable manner in a path parallel to said transport path; storage means for storing said spacers in overlying relation, said storage means comprising a magazine having guides directed towards said transport path, the lowermost spacer in the magazine lying on the guide bars and having its driving stop means projecting downwardly into the transport path of the leading edges of the printed products, whereby each delivered spacer is moved by the printed product along said guide means, said spacers each being provided with an upper surface for supporting a spacer next higher in the magazine, said upper supporting surface being inclined downwardly in a direction opposite to the transport direction, said spacers each additionally comprising feed pins and a feed lug which falls downwardly away from the spacer in the transport direction, the feed lug of the spacer which is lowermost in the magazine, as the lowermost spacer is moved, running against feed pins on the next higher spacer to displace said next higher spacer downwardly and along the upper surface of said lowermost spacer; and brake means disposed at a distance downstream of said storage means for ensuring that each spacer abuts with its leading abutment means against the trailing abutment means of the preceding spacer.

* * * * *